US007111838B2

(12) United States Patent
Sasa et al.

(10) Patent No.: US 7,111,838 B2
(45) Date of Patent: Sep. 26, 2006

(54) SHEET PROCESSING APPARATUS HAVING DIFFERENT DISCHARGE CONTROL FOR STAPLING OPERATION

(75) Inventors: Kazunori Sasa, Ibaraki (JP); Yoshinori Isobe, Ibaraki (JP)

(73) Assignees: Canon Kabushiki Kaisha, (JP); Canon Finetech Inc., (JP)

( * ) Notice: Subject to any disclaimer, the term of this patent is extended or adjusted under 35 U.S.C. 154(b) by 0 days.

(21) Appl. No.: 11/272,850

(22) Filed: Nov. 14, 2005

(65) Prior Publication Data

US 2006/0066020 A1 Mar. 30, 2006

Related U.S. Application Data

(63) Continuation of application No. 10/644,596, filed on Aug. 20, 2003, now Pat. No. 6,981,697.

(30) Foreign Application Priority Data

Aug. 22, 2002 (JP) ..... 2002-241836

(51) Int. Cl.
*B65H 37/04* (2006.01)

(52) U.S. Cl. ..... 270/58.11; 270/58.09; 399/410

(58) Field of Classification Search ..... 270/58.08, 270/58.09, 58.11; 399/410
See application file for complete search history.

(56) References Cited

U.S. PATENT DOCUMENTS

| | | | | |
|---|---|---|---|---|
| 5,746,162 | A | 5/1998 | Hosoi et al. | |
| 6,234,474 | B1 | 5/2001 | Horii et al. | |
| 6,517,065 | B1 | 2/2003 | Miyake et al. | |
| 6,574,011 | B1 * | 6/2003 | Sato et al. | 358/401 |
| 6,674,976 | B1 | 1/2004 | Sato et al. | |

FOREIGN PATENT DOCUMENTS

| | | | |
|---|---|---|---|
| JP | 5-39163 | A | 2/1993 |
| JP | 8-73108 | A | 3/1996 |
| JP | 8-91686 | A | 4/1996 |
| JP | 10-250912 | A | 9/1998 |
| JP | 11-286353 | A | 10/1999 |
| JP | 11286353 | A * | 10/1999 |
| JP | 2002-193495 | A | 7/2002 |

* cited by examiner

*Primary Examiner*—Patrick Mackey
(74) *Attorney, Agent, or Firm*—Rossi, Kimms & McDowell LLP

(57) ABSTRACT

There is provided a sheet processing apparatus that is capable of preventing a stapled sheet bundle from being misaligned at a side edge thereof or becoming torn or wrinkled when the sheet bundle is discharged. The sheet processing apparatus comprises a stapler that staples a sheet bundle comprising a plurality of sheets, downstream discharge rollers that discharge the sheet bundle, a driving motor that drives the downstream discharge rollers, and a controller that controls the driving device. The controller controls discharge of the sheet bundle in different ways between a case where the stapler staples the sheet bundle at one point thereof and a case where the stapler staples the sheet bundle at two points thereof.

5 Claims, 13 Drawing Sheets

SHEET PROCESSING APPARATUS HAVING DIFFERENT DISCHARGE CONTROL FOR STAPLING OPERATION

CROSS-REFERENCE TO RELATED APPLICATION

This application is a Continuation of and claims priority from U.S. application Ser. No. 10/644,596 filed on Aug. 20, 2003 now U.S. Pat. No. 6,981,697. No new matter has been added.

BACKGROUND OF THE INVENTION

1. Field of the Invention

The present invention relates to a sheet processing apparatus that discharges a sheet bundle comprised of a plurality of sheets.

2. Description of the Related Art

Conventionally, there has been known an image forming apparatus such as a copying machine, to which can be attached an original feeder that automatically feeds originals, and a sheet processing apparatus such as a finisher or a stitcher that selectively carries out a sorting process in which sheets with images recorded thereon are subjected to alignment, sorting, or the like, a stapling process in which a sheet bundle comprised of a plurality of sheets is selectively stapled, a folding process in which a sheet bundle comprised of a plurality of sheets is selectively folded, a stacking-process in which sheets or sheet bundles are stacked and stored, and other processes. The original feeder and the sheet processing apparatus are connected to each other to constitute the image forming apparatus.

An example of the stapling process carried out by the sheet processing apparatus is a one-point stapling in which a sheet bundle is stapled at one of two corners thereof in the direction of the sheet width. The stapled sheet bundle is discharged and stacked onto a tray by discharging rollers, which are driven with at a discharging speed controlled to a constant speed. The sheet processing apparatus is conventionally designed to be attached to a black-and-white image forming apparatus.

However, in the case where the sheet processing apparatus which has been attached to a black-and-white copying machine is attached as it is to a color copying machine, since the frictional coefficient of color output sheets is smaller than that of black-and-white output sheets, when a sheet bundle stapled at any corner thereof is discharged by a downstream discharging device disposed downstream in the sheet conveying direction while the discharge speed is controlled to a constant speed as in the prior art, the sheet bundle may be misaligned at a side edge thereof which has not been subjected to the stapling process, or may become torn or wrinkled in the vicinity of the stapling point. Such phenomena are caused by friction between sheets themselves or image toners recorded on the sheets, and if the friction between the sheets is small, significant misalignment of the sheets or the like occurs. For example, in the case of sheets (recording sheets) for use in black-and-white copying machines, no problem is encountered in the prior art control since the friction between the sheets (recording sheets) for use in black-and-white copying machines is great, but in the case of sheets (recording sheets) for use in color copying machines, where toner is applied over the entire surfaces of the sheets as in the case of a photographic image, the friction between the sheets tends to be small, and hence the misalignment of the sheets or the like is significant. Further, as the acceleration of the start-up speed at the start of conveyance of a sheet bundle increases, the friction between the sheets behaves as dynamic friction so that the friction coefficient between the sheets decreases (the coefficient of dynamic friction<the coefficient of static friction), and hence the sheets are more likely to be misaligned due to an impact occurring upon the start-up.

SUMMARY OF THE INVENTION

It is therefore a first object of the present invention to provide a sheet processing apparatus that is capable of preventing a stapled sheet bundle from being misaligned at a side edge thereof or becoming torn or wrinkled when the sheet bundle is discharged.

It is a second object of the present invention to provide a sheet processing apparatus that is capable of providing control to increase the sheet bundle conveying speed during discharge of a sheet bundle to reduce the period of time required for processing in the case where the sheet bundle is not stapled, so that the productivity can be improved.

To attain the first object, in a first aspect of the present invention, there is provided a sheet processing apparatus comprising a stapling device that staples a sheet bundle comprising a plurality of sheets, a discharge device that discharges the sheet bundle, a driving device that drives the discharge device; and a controller that controls the driving device; and wherein the controller controls discharge of the sheet bundle in different ways between a case where the stapling device staples the sheet bundle at one point thereof and a case where the stapling device staples the sheet bundle at two points thereof.

With this arrangement, the controller controls discharge of a sheet bundle in different ways between the case where the stapling device staples the sheet bundle at one point thereof and the case where the stapling device staples the sheet bundle at two points thereof, so that the sheet bundle can be discharged in a manner suitable for each of the case where the stapling device staples the sheet bundle at one point thereof and the case where the stapling device staples the sheet bundle at two points thereof. As a result, it is possible to prevent a stapled sheet bundle from being misaligned at a side edge or becoming torn or wrinkled when the sheet bundle is discharged.

Preferably, the sheet bundle stapled at one point thereof is a sheet bundle stapled at one of corners thereof by said stapling device, and the sheet bundle stapled at two points thereof is a sheet bundle stapled by the stapling device at symmetrical points thereof with respect to a middle part thereof in a direction of sheet width perpendicular to a sheet bundle conveying direction.

With this arrangement, substantially the same effects as those of the first aspect of the present invention can be obtained.

To attain the second object, the controller is operable when the sheet bundle stapled at one point thereof is to be discharged, for causing the discharge device to discharge the sheet bundle while controlling a speed of the sheet bundle to be maintained at a first predetermined speed, and the controller is operable when the sheet bundle stapled at two points thereof is to be discharged, for continuously applying a predetermined voltage to the driving device to cause the discharge device to convey the sheet bundle until after the sheet bundle has been conveyed by a predetermined distance, and is operable after the sheet bundle has been conveyed by the predetermined distance, for causing the discharge device to discharge the sheet bundle while controlling the speed of the sheet bundle to be maintained at the first predetermined speed.

With this arrangement, when the sheet bundle stapled at one point thereof is to be discharged, the controller causes the discharge device to discharge the sheet bundle while controlling a speed of the sheet bundle to be maintained at a first predetermined speed, and when the sheet bundle stapled at two point thereof is to be discharged, the controller continuously applies a predetermined voltage to the driving device and causes the discharge device to convey the sheet bundle until after the sheet bundle has been conveyed by a predetermined distance, and after the sheet bundle has been conveyed by the predetermined distance, the controller causes the discharge device to discharge the sheet bundle while controlling the speed of the sheet bundle to be maintained at the first predetermined speed. As a result, it is possible to prevent a sheet bundle stapled at one point thereof from being misaligned at a side edge thereof which has not been subjected to stapling, or becoming torn or wrinkled in the vicinity of the stapling point, and to improve the periodicity by reducing the period of time required for processing in discharging a sheet bundle stapled at two points thereof.

Also preferably, the controller is operable when the sheet bundle stapled at one point thereof is to be discharged, for causing the discharge device to accelerate the sheet bundle at a first predetermined acceleration and then causing the discharge device to discharge the sheet bundle while controlling a speed of the sheet bundle to be maintained at the first predetermined speed, and the controller is operable when the sheet bundle stapled at two points thereof is to be discharged, for causing the discharge device to accelerate the sheet bundle at a second predetermined acceleration greater than the first predetermined acceleration, and then causing the discharge device to discharge the sheet bundle while controlling the speed of the sheet bundle to be maintained at the first predetermined speed.

With this arrangement, it is possible to reliably improve the periodicity by reducing the period of time required for processing in discharging a sheet bundle stapled at two points thereof.

Further preferably, said controller is operable when the sheet bundle stapled at one point thereof is to be discharged, for causing said discharge device to discharge the sheet bundle while controlling the speed of the sheet bundle to be maintained at a first predetermined speed; and said controller is operable when the sheet bundle stapled at two points thereof is to be discharged, for causing said discharge device to convey the sheet bundle while controlling the speed of the sheet bundle to be maintained at a second predetermined speed higher than the first predetermined speed until after the sheet bundle has been conveyed by a predetermined distance, and is operable after the sheet bundle has been conveyed by the predetermined distance, for causing the discharge device to discharge the sheet bundle while controlling the speed of the sheet bundle to be maintained at the first predetermined speed.

With this arrangement, it is possible to reliably improve the periodicity by reducing the period of time required for processing in discharging a sheet bundle stapled at two points thereof.

To attain the first object, in a second aspect of the present invention, there is provided a sheet processing apparatus comprising a stapling device that staples a sheet bundle comprising a plurality of sheets, a discharge device that discharges the sheet bundle, a driving device that drives discharge device, and a controller that controls the driving device, and wherein the controller controls discharge of the sheet bundle in different ways between a case where the stapling device staples the sheet bundle and a case where the stapling device does not staple the sheet bundle.

With this arrangement, the controller controls discharge of a sheet bundle in different ways between the case where the stapling device staples the sheet bundle and the case where the stapling device does not staple the sheet bundle, so that the sheet bundle can be discharged in a manner suitable for each of the case where the stapling device staples the sheet bundle and the case where the stapling device does not staple the sheet bundle. As a result, it is possible to prevent a stapled sheet bundle from being misaligned at a side edge or becoming torn or wrinkled when the sheet bundle is discharged.

To attain the second object, the controller is operable when a stapled sheet bundle is to be discharged, for causing the discharge device to discharge the sheet bundle while controlling the speed of the sheet bundle to be maintained at a first predetermined speed, and the controller is operable when an unstapled sheet bundle is to be discharged, for continuously applying a predetermined voltage to the driving device to cause the discharge device to convey the sheet bundle until after the sheet bundle has been conveyed by a predetermined distance, and is operable after the sheet bundle has been conveyed by the predetermined distance, for causing the discharge device to discharge the sheet bundle while controlling the speed of the sheet bundle to be maintained at the first predetermined speed.

With this arrangement, when a stapled sheet bundle is to be discharged, the controller causes the discharge device to discharge the sheet bundle while controlling a speed of the sheet bundle to be maintained at a first predetermined speed, and when an unstapled sheet bundle is to be discharged, the controller continuously applies a predetermined voltage to the driving device and causes the discharge device to convey the sheet bundle until after the sheet bundle has been conveyed by a predetermined distance, and after the sheet bundle has been conveyed by the predetermined distance, the controller causes the discharge device to discharge the sheet bundle while controlling the speed of the sheet bundle to be maintained at the first predetermined speed. As a result, it is possible to prevent a stapled sheet bundle from being misaligned at a side edge thereof which has not been subjected to stapling, or becoming torn or wrinkled in the vicinity of the stapling point, and to improve the periodicity by reducing the period of time required for processing in discharging an unstapled sheet bundle.

Also preferably, the controller is operable when the stapled sheet bundle is to be discharged, for causing the discharge device to accelerate the sheet bundle at a first predetermined acceleration and then causing the discharge device to discharge the sheet bundle while controlling the speed of the sheet bundle to be maintained at a first predetermined speed; and the controller is operable when an unstapled sheet bundle is to be discharged, for causing the discharge device to accelerate the sheet bundle at a second predetermined acceleration greater than the first predetermined acceleration, and then causing the discharge device to discharge the sheet bundle while controlling the speed of the sheet bundle to be maintained at the first predetermined speed.

With this arrangement, it is possible to reliably improve the periodicity by reducing the period of time required for processing in discharging an unstapled sheet bundle.

Further preferably, the controller is operable when a stapled sheet bundle is to be discharged, for causing the discharge device to discharge the sheet bundle while controlling the speed of the sheet bundle to be maintained at a first predetermined speed, and the controller is operable when an unstapled sheet bundle is to be discharged, for causing the discharge device to convey the sheet bundle while controlling the speed of the sheet bundle to be maintained at a second predetermined speed higher than the first predetermined speed until after the sheet bundle has been conveyed by a predetermined distance, and is operable after the sheet bundle has been conveyed by the predetermined distance, for causing the discharge device to discharge the sheet bundle while controlling the speed of the sheet bundle to be maintained at the first predetermined speed.

With this arrangement, it is possible to reliably improve the periodicity by reducing the period of time required for processing in discharging an unstapled sheet bundle.

The above and other objects, features, and advantages of the invention will become more apparent from the following detailed description taken in conjunction with the accompanying drawings.

BRIEF DESCRIPTION OF THE DRAWINGS

FIGS. 8A and 8B are graphs showing the relationship between the speed and the time when a sheet bundle is discharged, according to the first embodiment, in which:

FIG. 8A shows a case where "one-point stapling" is not carried out; and

FIG. 8B shows a case where "one-point stapling" is carried out;

FIGS. 10A and 10B are graphs showing the relationship between the speed and the time when a sheet bundle is discharged, according to the second embodiment, in which:

FIG. 10A shows a case where "one-point stapling" is not carried out; and

FIG. 10B shows a case where "one-point stapling" is carried out;

FIGS. 12A and 12B are graphs showing the relationship between the speed and the time when a sheet bundle is discharged, according to the third embodiment, in which:

FIG. 12A shows a case where "one-point stapling" is not carried out; and

FIG. 12B shows a case where "one-point stapling" is carried out; and

DETAILED DESCRIPTION OF THE PREFERRED EMBODIMENTS

The present invention will now be described in detail with reference to the drawings showing preferred embodiments thereof.

Figure 1:
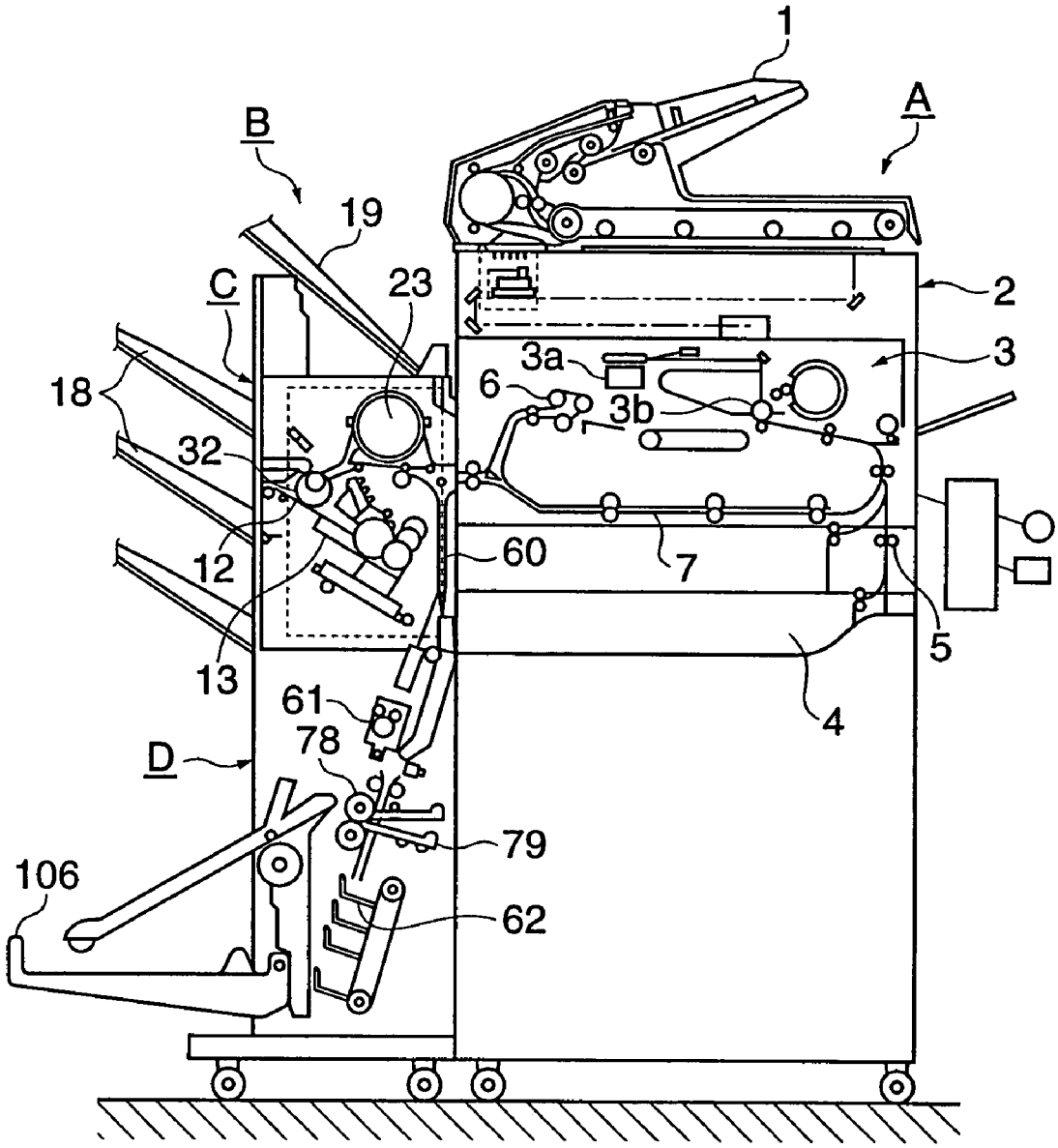
FIG. 1 is a sectional view showing the construction of an image forming apparatus to which is attached a sheet processing apparatus according to a first embodiment of the present invention.

FIG. 1 is a sectional view showing the construction of an image forming apparatus to which is attached a sheet processing apparatus according to a first embodiment of the present invention.

The image forming apparatus in FIG. 1 is implemented by a copying machine, for example.

The copying machine is constructed such that a sheet processing apparatus B is connected to an image forming apparatus main body A. The sheet processing apparatus B is comprised of a finisher unit C that is capable of sorting sheets, on which images have been formed by the image forming apparatus main body A, on a copy-by-copy basis, and a stitcher unit D that is capable of binding a plurality of sheets by stapling and folding.

First, a brief description will be given of the entire construction of the copying machine, and next a detailed description will be given of the constructions of the finisher unit C and the stitcher unit D in the sheet processing apparatus B.

The image forming apparatus main body A optically reads an original, which is automatically fed from an original feeder 1 attached to an upper part of the image forming apparatus main body A, as image information by means of a scanner section 2, and transmits the read image information as a digital signal to an image forming section 3, which records the digital signal (forms an image) on a recording sheet such as a plain sheet or an OHP sheet.

A plurality of sheet cassettes 4, which are adapted to store sheets of various sizes, are attached to a lower part of the image forming apparatus main body A, and a sheet conveyed from any of the sheet cassettes 4 by a pair of conveying rollers 5 is subjected to image formation based on electrophotography by the image forming section 3. Specifically, laser light emitted from a laser unit 3*a* is irradiated upon a photosensitive drum 3*b* in accordance with the information read by the scanner section 2, so that a latent image is formed on the surface of the photosensitive drum 3*b* and is developed by toner and transferred onto a sheet. The sheet is then conveyed to a fixing section 6 so that the image can be permanently fixed by heating and pressurizing.

In a one-sided recording mode in which an image is formed only on one side of a sheet, a sheet having passed through the fixing section 6 is conveyed to the sheet processing apparatus B. In a double-sided recording mode in which images are formed on both sides of a sheet, a sheet with an image formed on one side thereof, having passed through the fixing section 6 is conveyed to a refeed path 7 by switchback and conveyed again to the image forming section 3 so that an image can be formed on the other side of the sheet, and the sheet is then conveyed to the sheet processing apparatus B.

Figure 2:
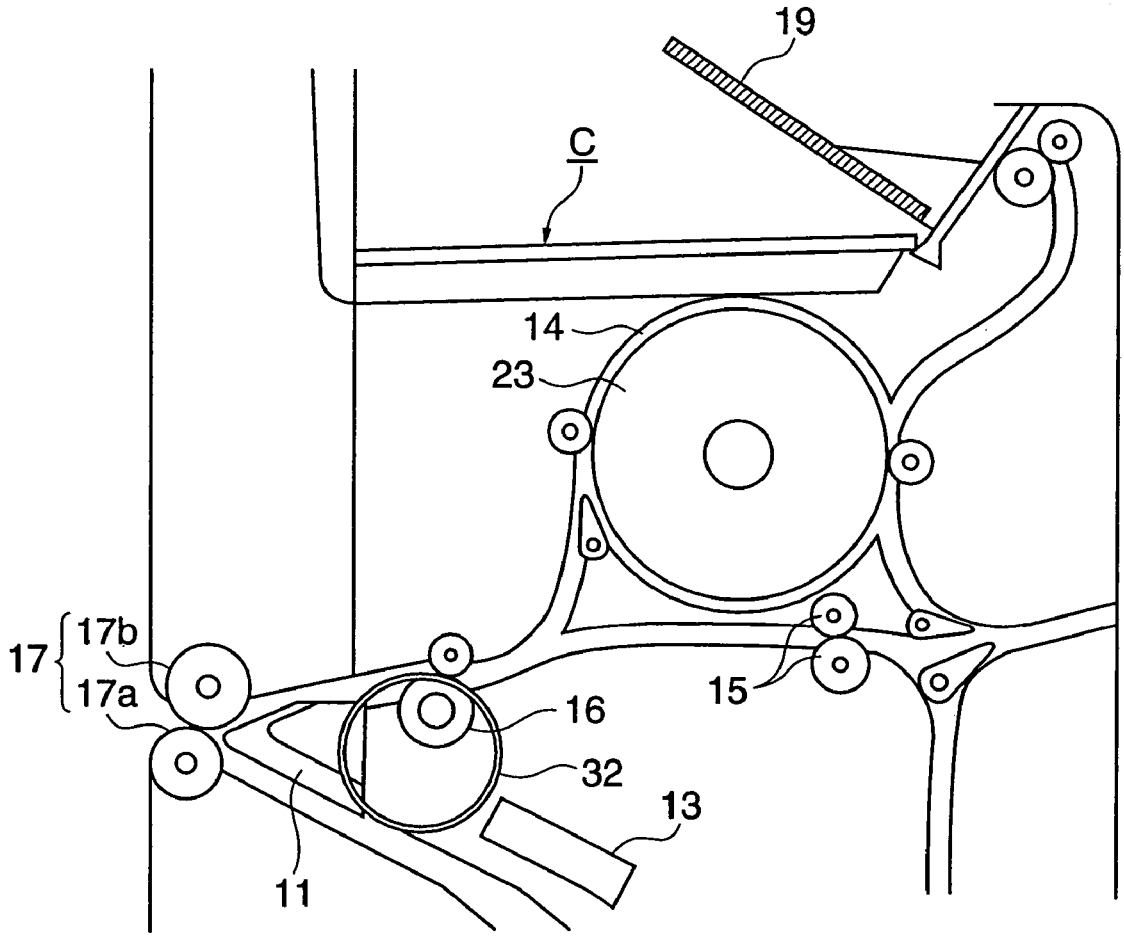
FIG. 2 is a fragmentary sectional view showing a part of a finisher unit of the sheet processing apparatus B appearing in FIG. 1.

FIG. 2 is a fragmentary sectional view showing the construction of a part of the finisher unit C of the sheet processing apparatus B appearing in FIG. 1.

The finisher unit C enables sheets to be discharged in a manner suitable for each of an offset mode, a staple sort mode, and so forth in addition to a normal discharge mode.

The offset mode is an operation mode in which when the first sheet of each copy is discharged in the case where sheets are sorted and discharged on a copy-by-copy basis, a side guide 11 (refer to FIG. 5) is moved to shift a sheet in the direction of the width thereof (perpendicular to the sheet conveying direction) by a predetermined amount, and the second and subsequent sheets of each copy are normally discharged onto the first sheet so that boundaries between copies can be recognized.

The staple sort mode is an operation mode in which when sheets are sorted and discharged on a copy-by-copy basis, the sheets are aligned and stacked on a staple tray 12 and stapled by a stapler 13 (stapling process) so that sheets stapled on a copy-by-copy basis can be discharged.

It should be noted that sheets are normally discharged one by one, but two sheets may be discharged at the same time. In the case where two sheets are discharged at the same time, a first sheet conveyed from the image forming apparatus main body A to the sheet processing apparatus B is temporarily retained on a buffer path 14 provided in the finisher unit C, and the first sheet and a second sheet discharged next are superposed and wound around a buffer roller 23 and then discharged at the same time.

On the other hand, the stitcher unit D is capable of aligning sheets discharged from the image forming apparatus main body A on a copy-by-copy basis, stapling them by means of a staple unit 61, and folding them in two, as outlined below.

The sheets discharged from the image forming apparatus main body A are conveyed to a longitudinal path 60 of the stitcher unit D and aligned on a copy-by-copy basis such that the lower ends of the sheets abuts on a stopper 62. The staple unit 61 then staples the sheets at two points thereof at a middle part thereof in the direction of the sheet length (sheet conveying direction) (two-point stapling). If "one-point stapling" is carried out, the stapler 13 staples a sheet bundle at one point thereof selected from corners of the sheet bundle, and if "two-point stapling" is carried out, the stapler 13 staples a sheet bundle at symmetrical points with respect to a middle position in the direction of the sheet width, which is perpendicular to the sheet bundle conveying direction.

The stopper 62 is then moved down to shift the sheet bundle until the stapling points of the sheet bundle reach a nip position between folding rollers 78, and a striking plate 79 strikes the sheet bundle at the stapling points, and the sheet bundle is conveyed while being nipped between the folding rollers 78 such that the sheet bundle is folded in two at the stapling points thereof. As a result, the sheet bundle is stapled in the center thereof in the direction of the sheet length, and the thus bound sheet bundle folded in two is discharged onto a stacking tray 106.

A detailed description will now be given of the construction of each component part of the finisher unit C.

In a normal mode, a sheet P discharged from the image forming apparatus main body A to the finisher unit C is conveyed by a pair of conveying rollers 15 and is discharged onto a stack tray 18 by a pair of upstream discharge rollers 16 and a pair of downstream discharge rollers 17. A plurality of stack trays 18 are provided and are each capable of being moved up and down by a driver which is incorporated in a lower part thereof. In a sort discharge mode, the plurality of stack trays 18 are sequentially moved to a discharge port 36 (refer to FIG. 3) so that the sheets P can be discharged in the state of being sorted on a copy-by-copy basis. In the offset mode and the staple sort mode, an offsetting process or a stapling process is carried out for one of the stack trays 18 so that the sheets P can be discharged in the state of being sorted. Further, in an interrupt mode, the sheets P can be discharged onto an upper tray 19 without being discharged onto the stack tray 18.

Figure 3:
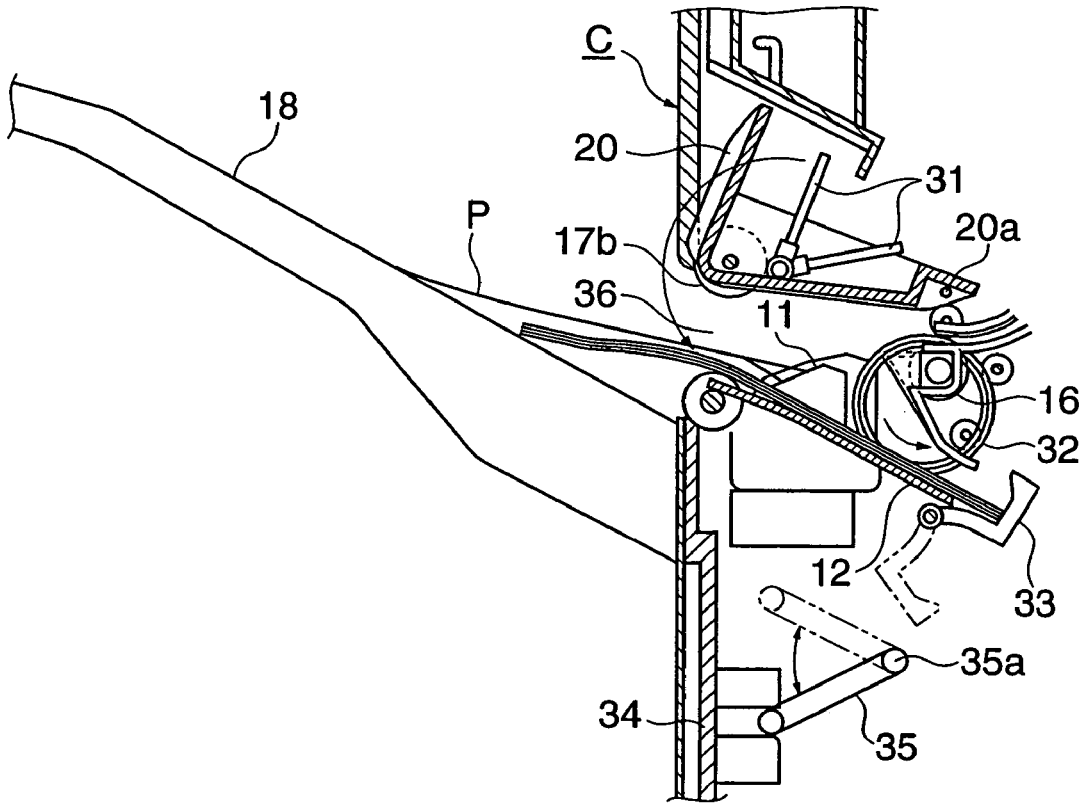
FIG. 3 is a fragmentary sectional view showing a staple tray section of the sheet processing apparatus appearing in FIG. 1.

FIG. 3 is a fragmentary sectional view showing the construction of a staple tray section of the sheet processing apparatus B appearing in FIG. 1.

In the staple sort mode, a swing guide 20 is opened to cause the pair of upstream discharge rollers 16 to discharge the sheet P onto the staple tray 12, and pivotable puddles 31 provided in the swing guide 20 and a knurled belt 32 rotatively driven by the pair of upstream discharge rollers 16 are rotated in respective directions indicated by arrows in FIG. 3 so that the trailing end of the sheet P can be returned to such a location as to abut on a trailing end stopper 33. The side guide 11 then pushes the sheets P to one side and aligns them, and the stapler 13 staples the sheets P.

If the pair of upstream discharge rollers 16 discharge the sheet P at a high speed when the sheet P is discharged onto the staple tray 12, the sheet P released from the pair of upstream discharge rollers 16 jumps out when discharged, and excessively advances forward (toward a stacker tray) since the swing guide 20 is opened. Therefore, it takes much time to pull back the sheet P. Further, in the case where the sheet P excessively advances forward, even if the sheet P is pulled back by patting it with the pivotable puddles 31, the sheet P cannot be returned to the knurled belt 32, and may not be aligned on the staple tray 12.

Therefore, in the present embodiment, in the staple sort mode, the rotational speed of the pair of upstream discharge rollers 16 is switched to a low speed so that the rotational speed of the pair of upstream discharge rollers 16 can be low when the trailing end of the sheet P passes through the pair of upstream discharge rollers 16. As a result, the trailing end of the sheet P discharged onto the staple tray 12 falls into an area in the vicinity of the knurled belt 32, and the sheet P is reliably pulled by the rotations of the puddles 31 and the knurled belt 32. In this way, the trailing ends of the sheets P can be aligned.

It should be noted that whether or not the trailing end of the sheet P passes through the pair of upstream discharge rollers 16 can be determined by detecting whether a predetermined period of time has elapsed after the sheet P has passed through a predetermined sensor or whether the motor rotational speed exceeds a predetermined motor rotational speed.

Further, after the trailing end of the sheet P falls onto the staple tray 12, the rotational speed of the upstream discharge rollers 16, which has been switched to a low speed, is then switched to a high speed. The pair of upstream discharge rollers 16 also act to rotate the knurled belt 32, and hence the sheet P fallen onto the staple tray 12 is pulled back quickly by the knurled belt 32, so that the trailing end of the sheet P comes into abutment on the trailing end stopper 33.

As described above, in the staple sort mode, the conveying speed is decreased only in the case where the trailing end of sheets passes through the pair of upstream discharge rollers 16, whereby the sheets can be aligned quickly as a whole.

A brief description will now be given of the swing guide 20 with reference to FIG. 4.

Figure 4:
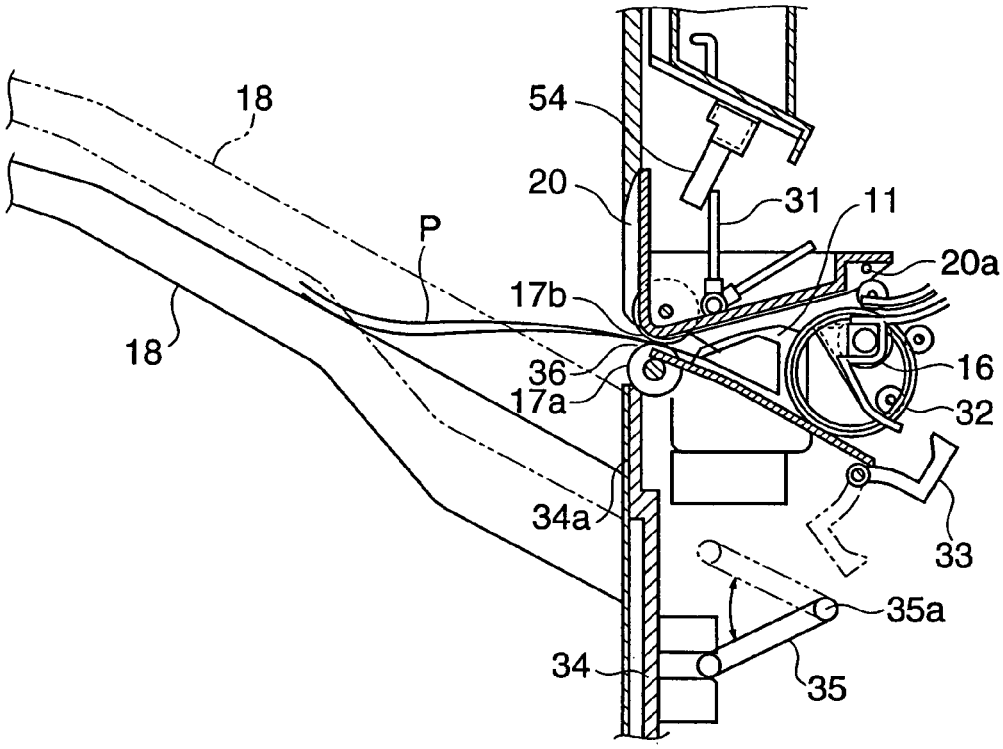
FIG. 4 is a fragmentary sectional view similar to FIG. 3, showing the construction of the staple tray section.

FIG. 4 is a fragmentary sectional view similar to FIG. 3, showing the construction of the staple tray section.

The swing guide 20 rotatably supports a moving discharge roller 17*b* and is swung downward about a swing shaft 20*a* by a driving mechanism 39, described later, during sheet discharge, so that the moving discharge roller 17*b* is brought into urging contact with a downstream discharge roller 17*a*. Further, in the staple sort mode, the swing guide 20 is swung upward about the swing shaft 20*a* by the driving mechanism 39 to separate the moving discharge roller 17*b* from the downstream discharge roller 17*a*. Specifically, the swing guide 20 serves as a switching means for selectively switching the state of the pair of downstream discharge rollers 17 consisting of the moving discharge roller 17*b* and the downstream discharge roller 17*a* into a sheet dischargeable state or into a sheet undischargeable state.

It should be noted that preference numeral 34 in FIG. 4 denotes a stopper which has a shatter section 34*a* at an upper end thereof. When the stack tray 18 is moved, a link 35 rotates upward about a rotary shaft 35*a* to move up the stopper 34, i.e. the shutter section 34*a*. This causes the shutter section 34*a* to close the discharge port 36, so that when the stack tray 18 has moved to the discharge port 36, sheets (or a bundle of sheets) stacked on the stack tray 18 can be inhibited from being going back to the discharge port 36. It should be noted that the stopper 34 is configured such that during sheet discharge, the link 35 rotates downward about the rotary shaft 35*a* to move down the shutter section 34*a* and open the discharged port 36.

When the sheets P have been aligned and stacked on the staple tray 12, the downstream discharge roller 17*a* rotates by a predetermined amount in a direction opposite to the sheet discharging direction to convey the sheets P in such a direction as to pull them back. At the same time, the swing guide 20 is closed to prepare for the next processing.

As described before, a bundle of sheets P stacked on the staple tray 12 is sandwiched between the pair of downstream discharge rollers 17 and is then stapled by the stapler 13. A variety of combinations of stapling points can be envisaged, but in the present embodiment, the mode in which a sheet bundle is stapled at one point selected from corners thereof ("one-point stapling") as shown in FIG. 5 and the mode in which a sheet bundle is stapled at two points on a side thereof ("two-point stapling") are selectively executed.

Figure 5:
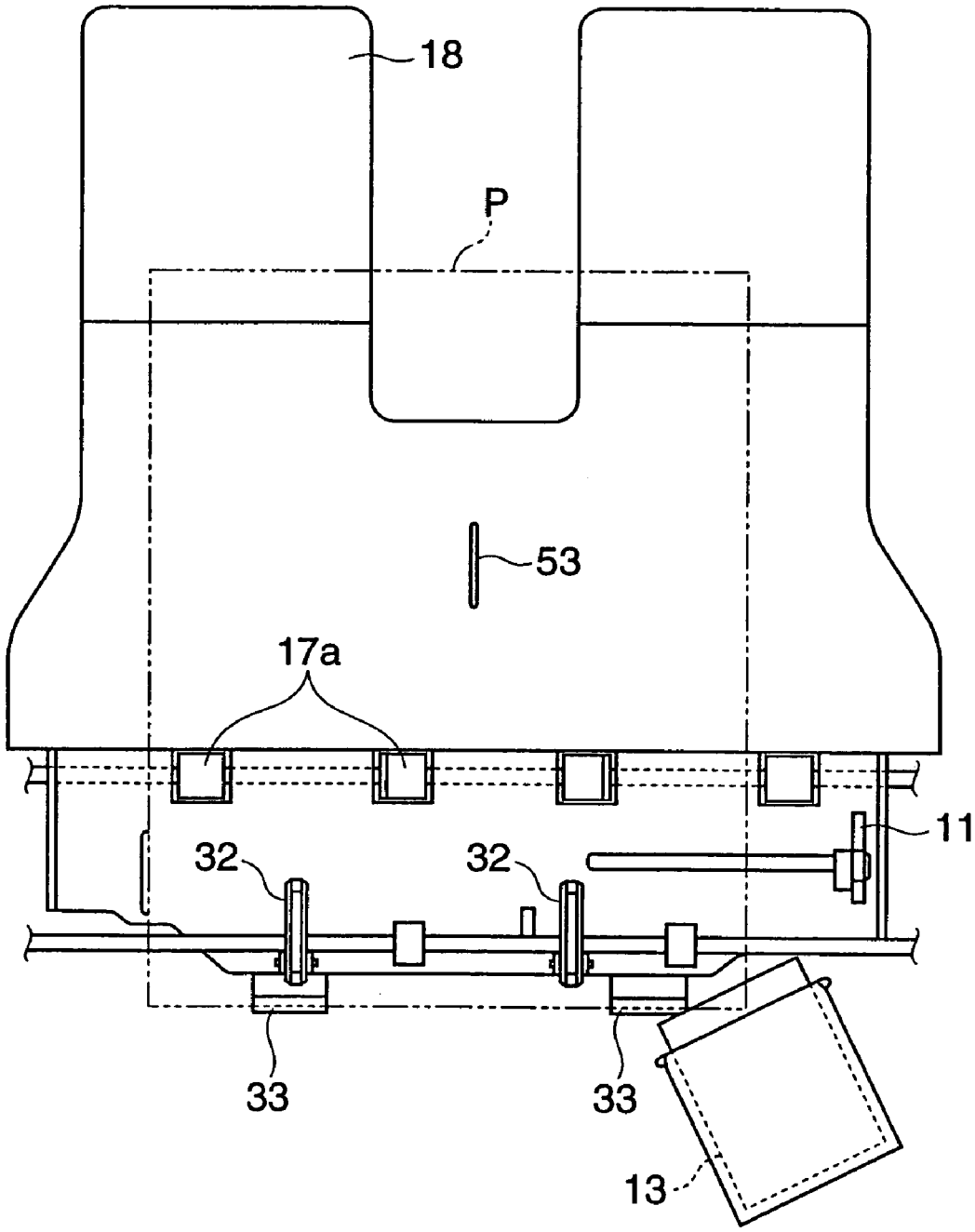
FIG. 5 is a top plan view showing a stapler and peripheral parts thereof.

FIG. 5 is a top plan view showing the stapler 13 and peripheral parts thereof.

In the case where the stapler 13 is not positioned at a predetermined stapling location, the stapler 13 needs to be moved to the predetermined stapling location, but the movement of the stapler 13 may displace a bundle of sheets P stacked on the staple tray 12. To address this problem, when the stapler 13 is moved, the side guide 11 urges the end of the bundle of sheets P, whereby the stacked sheets P can be prevented from being misaligned.

However, if the sheets P are stapled while the side guide 11 urges the end of the bundle of the sheets P, the urging of the side guide 11 may result in curving or the like of the bundle of the sheets P in the direction of the width thereof, and in this case, the sheets P cannot be properly stapled.

To address this problem, when the sheets P are stapled, the side guide 11 is separated from the bundle of the sheets P into a position as indicated by solid lines in FIG. 5 to release the urged end of the bundle from the side guide 11, so that the bundle of the sheets P can be stapled in the state of being sandwiched only between the pair of downstream discharge rollers 17. This prevents the bundle of the sheets P from becoming curved due to the urging of the side guide 11 and prevents the sheets P from being poorly stapled.

As described above, upon completion of stapling, the pair of downstream discharge rollers 17 are rotated in the conveying direction to discharge the bundle of the sheets P onto the stack tray 18.

When the bundle of the sheets P thus stapled is discharged, the bundle of sheets is likely to be misaligned at a side edge thereof which has not been subjected to stapling. This phenomenon is caused by the friction between the sheets P or toner of images formed on the sheets P. As the friction between the sheets P decreases, the degree of misalignment increases.

Further, as the acceleration of the start-up speed at the start of conveyance of a sheet bundle increases, the friction between the sheets behaves as dynamic friction so that the friction coefficient between the sheets decreases (dynamic coefficient of dynamic friction<the coefficient of static friction), and hence sheets are likely to be misaligned or wrinkled due to an impact occurring upon the start-up.

Figure 6:
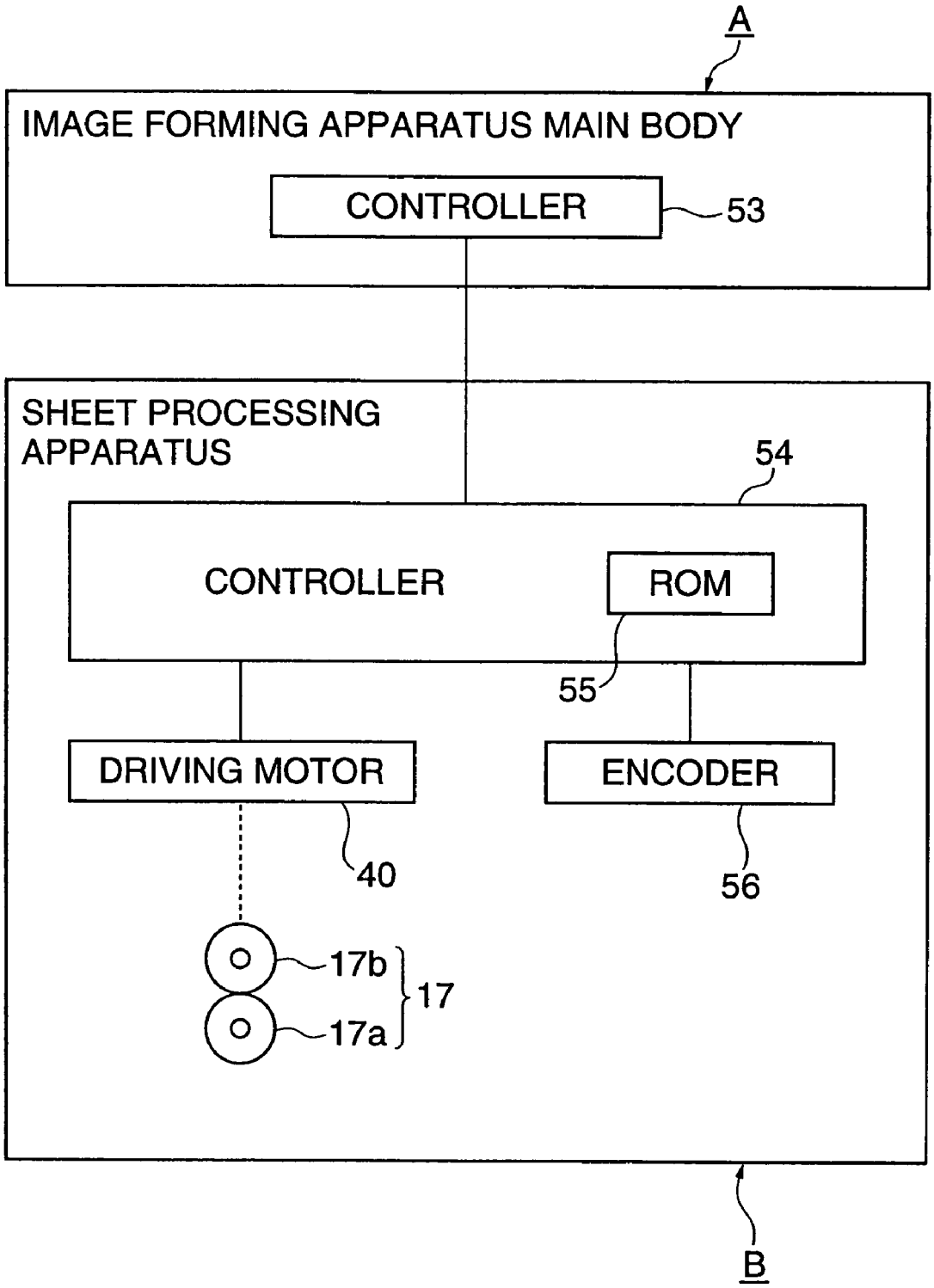
FIG. 6 is a block diagram schematically showing the constructions of parts of an image forming apparatus main body and the sheet processing apparatus, the parts being related to discharge control of a sheet bundle.

FIG. 6 is a block diagram schematically showing parts of the image forming apparatus main body and the sheet processing apparatus, the parts being related to discharge control of a sheet bundle.

The image forming apparatus main body A is comprised of a controller 53 that controls the operation of the image forming apparatus main body A. The sheet processing apparatus B is comprised of a controller 54 that controls the operation of the sheet processing apparatus B, an encoder 56 and a driving motor 40 which are connected to the controller 54, and the pair of downstream discharge rollers 17 (i.e. the downstream discharge roller 17*a* and the moving discharge roller 17*b*) driven by the driving motor 40. The controller 53 and the controller 54 are connected to each other so that the controller 53 can transmit information indicative of sheet size, various modes, operation timing, and so forth to the controller 54. During sheet bundle discharge, the controller 54 of the sheet processing apparatus B controls the rotational speed of the pair of downstream discharge rollers 17 by changing the output of the driving motor 40 while monitoring a signal transmitted from the encoder 56. The driving motor 40 is implemented by a DC motor and is capable of controlling the speed and output by chopper control.

The controller 53 of the image forming apparatus main body A transmits information indicative of whether the operation mode is the staple sort mode in which the stapling process is carried out or the sort mode in which the stapling process is not carried out to the controller 54 of the sheet processing apparatus B, so that the sheet processing apparatus B can be controlled in a manner suitable for each mode. A control program for providing such control is stored in a ROM 55 in the controller 54 of the sheet processing apparatus B. A concrete way of providing such control will be described later.

Figure 7:
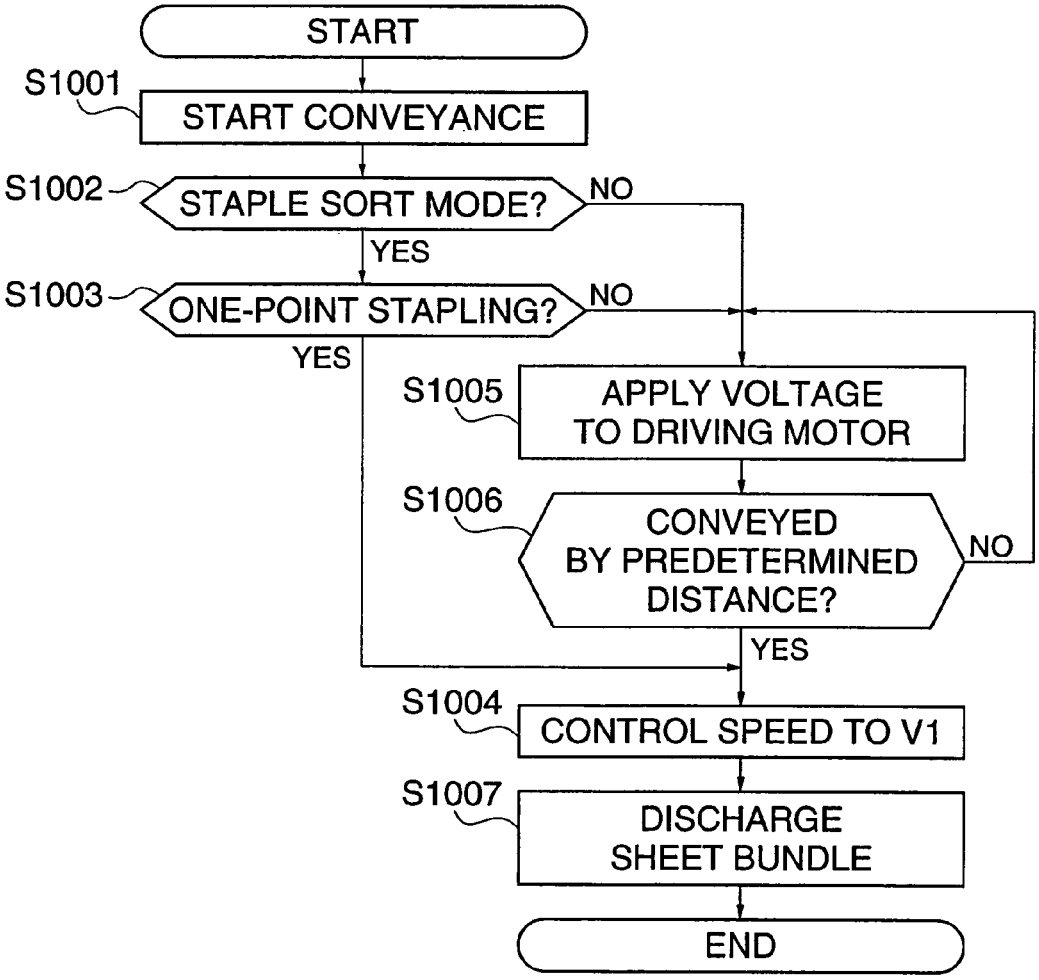
FIG. 7 is a flow chart showing a sheet bundle discharge control process that is carried out by the sheet processing apparatus according to the first embodiment.

FIG. 7 is a flow chart showing a sheet bundle discharge control process that is carried out by the sheet processing apparatus according to the present embodiment.

First, the conveyance of a sheet bundle from the staple tray 12 is started (step S1001). Next, it is determined whether the operation mode is the staple sort mode or not (step S1002). If it is determined that the operation mode is the staple sort mode, it is then determined whether "one-point stapling" is to be carried out or not (step S1003). If it is determined that "one-point stapling" is to be carried out, the speed of the sheet bundle being conveyed is controlled to be maintained at a predetermined speed V1 (step S1004), and the sheet bundle is then discharged onto the stack tray 18 with the conveying speed being maintained at the predetermined speed V1 (step S1007).

If it is determined in the step S1002 that the operation mode is not the staple sort mode, or if it is determined in the step S1003 that "one-point stapling" is not to be carried out (for example, in the case of "two-point stapling"), a predetermined voltage is continuously applied to the driving motor 40 without controlling the speed of the sheet bundle being conveyed until after the sheet bundle has been conveyed by a predetermined distance (steps S1005 and S1006). For example, such a predetermined voltage is applied that the driving motor 40 operates with the maximum output at the start-up.

Next, it is determined whether the sheet bundle has been conveyed by the predetermined distance or not (step S1006). If it is determined that the sheet bundle has been conveyed by the predetermined distance, the speed of the sheet bundle being conveyed is controlled to be maintained at the predetermined speed V1 (step S1004), and the sheet bundle is then discharged onto the stack tray 18 with the conveying speed being maintained at the predetermined speed V1 (step S1007).

Figure 8A:
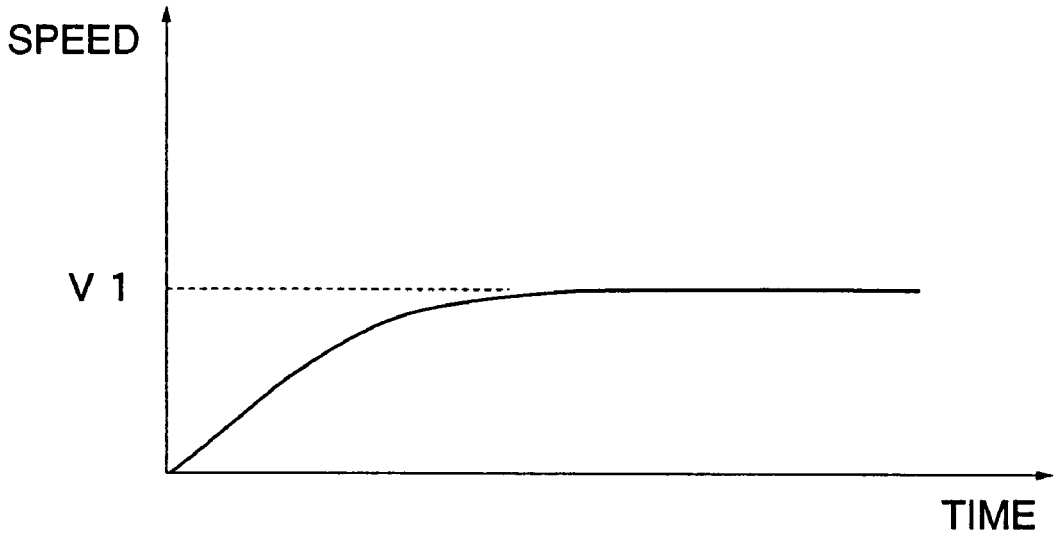
Figure 8B:
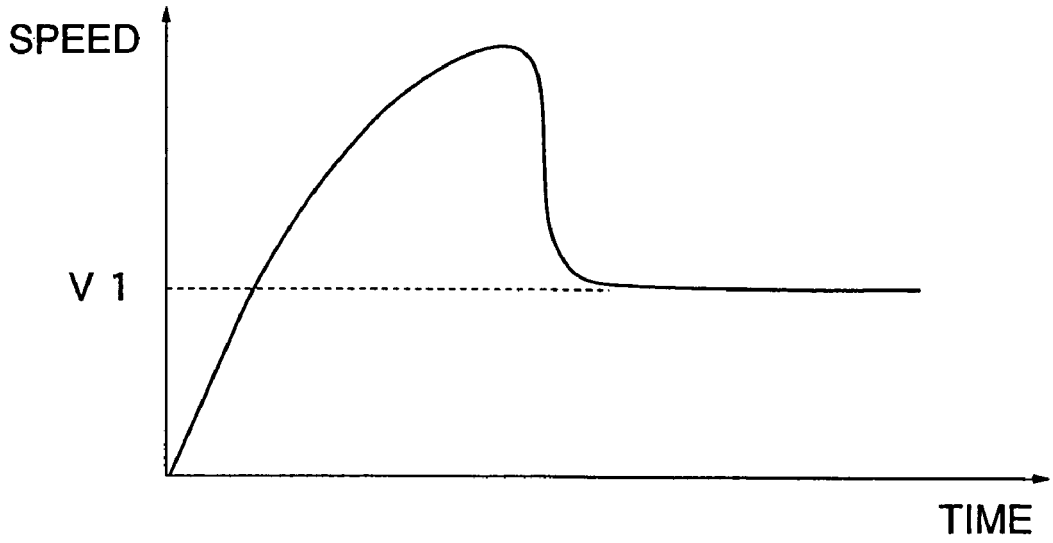

FIGS. 8A and 8B are graphs showing the relationship between the speed and the time when a sheet bundle is discharged, according to the first embodiment, in which FIG. 8A shows a case where "one-point stapling" is not carried out, and FIG. 8B shows a case where "one-point stapling" is carried out.

In the case shown in FIG. 8B, the speed immediately after the start of the motor 40 is higher than in the case shown in FIG. 8A, and hence it is possible to reduce the period of time required for processing. Further, in the case shown in FIG. 8A, the sheet bundle is slowly conveyed, and hence it is possible to prevent a sheet bundle from being misaligned at a side edge thereof which has not been subjected to stapling, or becoming torn or wrinkled in the vicinity of the stapling point. Further, in the present embodiment, the acceleration of conveyance of the sheet bundle immediately after the start of conveyance is controlled to be different between the case where "one-point stapling" is carried out and the case where "one-point stapling" is not carried out.

It should be noted that in the present embodiment, the way of controlling the speed at the start of the motor 40 is different between the case where "one-point stapling" is carried out and the case where "one-point stapling" is not carried out, but to maintain a constant sheet stackability, the conveying speed immediately before the trailing end of a sheet bundle is released from the downstream discharge roller 17*a* and the moving discharge roller 17*b* is controlled to be constant (V1). This also applies to other embodiments described below.

Figure 9:
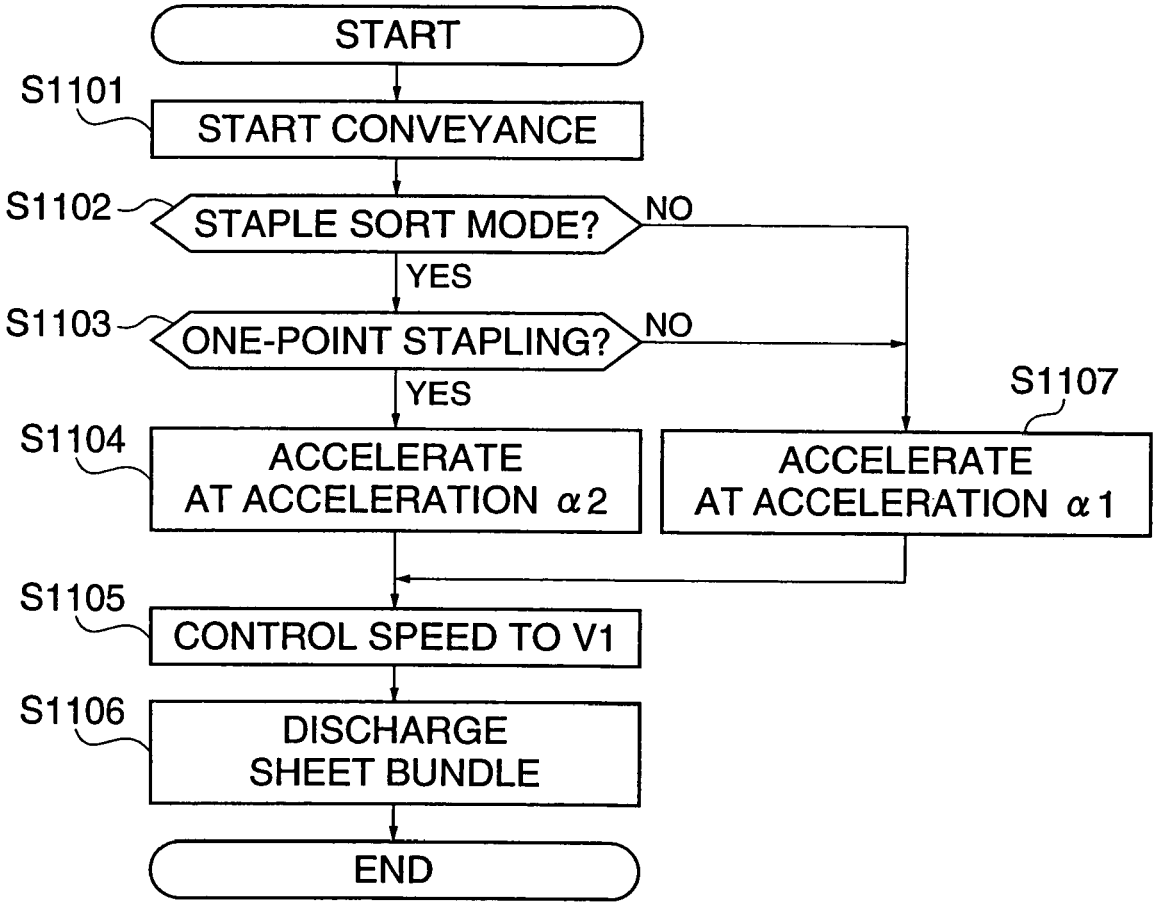
FIG. 9 is a flow chart showing a sheet bundle discharge control process that is carried out by the sheet processing apparatus according to a second embodiment of the present invention.

FIG. 9 is a flow chart showing a sheet bundle discharge control process that is carried out by a sheet processing apparatus according to a second embodiment of the present invention.

The present embodiment differs from the first embodiment described above in that the acceleration during sheet bundle conveyance is controlled to different values between the case where "one-point stapling" is carried and the case where "one-point stapling" is not carried out.

The sheet processing apparatus according to the present embodiment and an image forming apparatus to which the sheet processing apparatus is attached are identical in construction with those of the first embodiment, and hence description of the constructions thereof is omitted. In the sheet processing apparatus according to the present embodiment, the acceleration during sheet bundle conveyance is controlled using a stepping motor in place of the DC motor as the driving motor 40.

First, the conveyance of a sheet bundle from the staple tray 12 is started (step S1101). Next, it is determined whether the operation mode is the staple sort mode or not (step S1102), and if it is determined that the operation mode is the staple sort mode, it is then determined whether "one-point stapling" is to be carried out or not (step S1103). If it is determined that "one-point stapling" is to be carried out, the sheet bundle is accelerated at an acceleration $\alpha 2$ (step S1104), and the speed of the sheet bundle being conveyed is controlled to be maintained at the predetermined speed V1 (step S1105). The sheet bundle is then discharged onto the stack tray 18 with the conveying speed being maintained at (step S1106), followed by termination of the present process.

If it is determined in the step S1102 that the operation mode is not the staple sort mode, or if it is determined in the step S1102 that the operation mode is the staple sort mode but it is determined in the step S1103 that "one-point stapling" is not to be carried out (for example, in the case of "two-point stapling"), the sheet bundle is accelerated at an acceleration $\alpha 1$ ($\alpha 1 > \alpha 2$) (step S1107), and the conveying speed is controlled to be maintained at the predetermined speed V1 (step S1105). The sheet bundle is then discharged onto the stack tray 18 with the conveying speed being maintained at the predetermined speed V1 (step S1106), followed by termination of the present process.

Figure 10A:
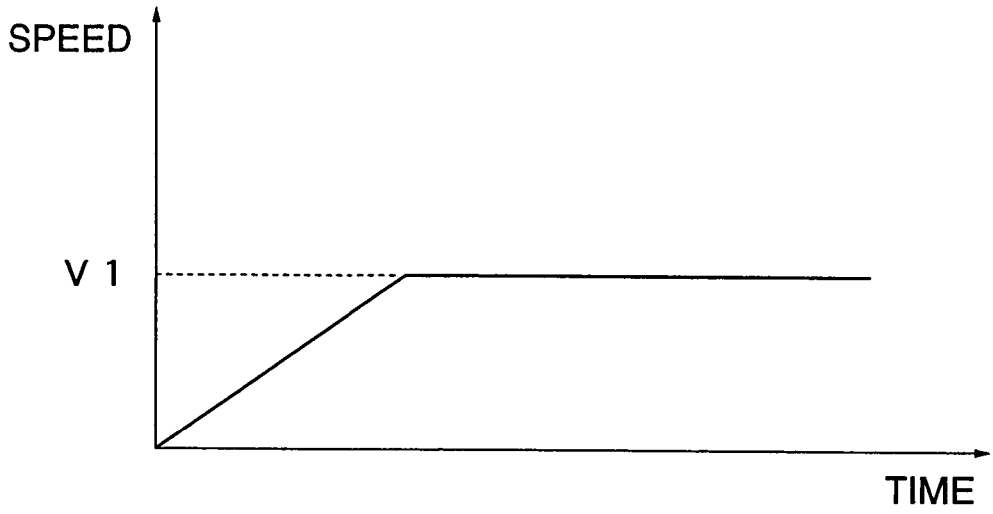
Figure 10B:
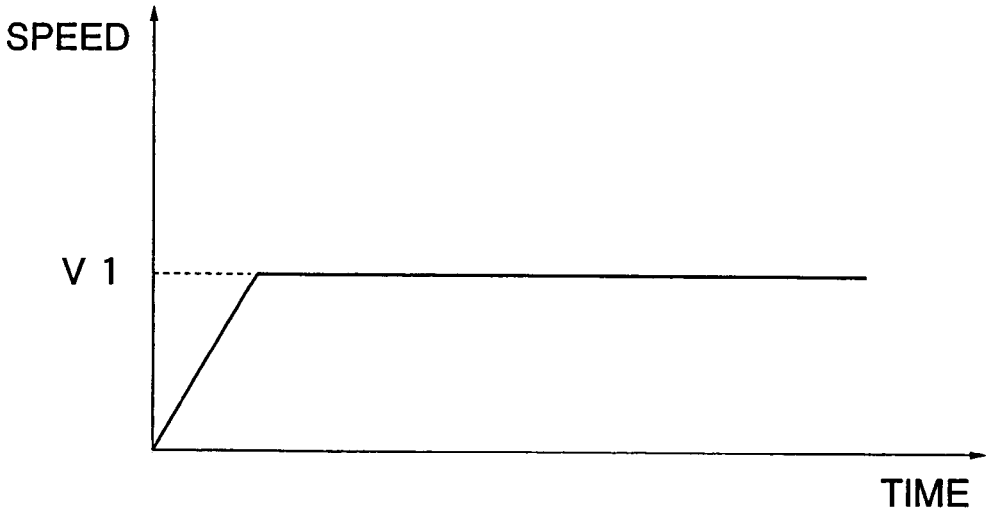

FIGS. 10A and 10B are graphs showing the relationship between the speed and the time when a sheet bundle is discharged, according to the second embodiment, in which FIG. 10A shows a case where "one-point stapling" is not carried out, and FIG. 10B shows a case where "one-point stapling" is carried out.

In FIG. 10B, the acceleration from the start of conveyance until the conveying speed becomes equal to the predetermined speed V1 is greater than in FIG. 10B. Therefore, in the case shown in FIG. 10B, it takes a shorter period of time until the conveying speed becomes equal to the predetermined speed V1, and hence the productivity can be improved. Further, since the sheet bundle is slowly conveyed in the case shown in FIG. 10A, it is possible to prevent a sheet bundle from being misaligned at a side edge thereof which has not been subjected to stapling, or becoming torn or wrinkled in the vicinity of the stapling point.

Figure 11:
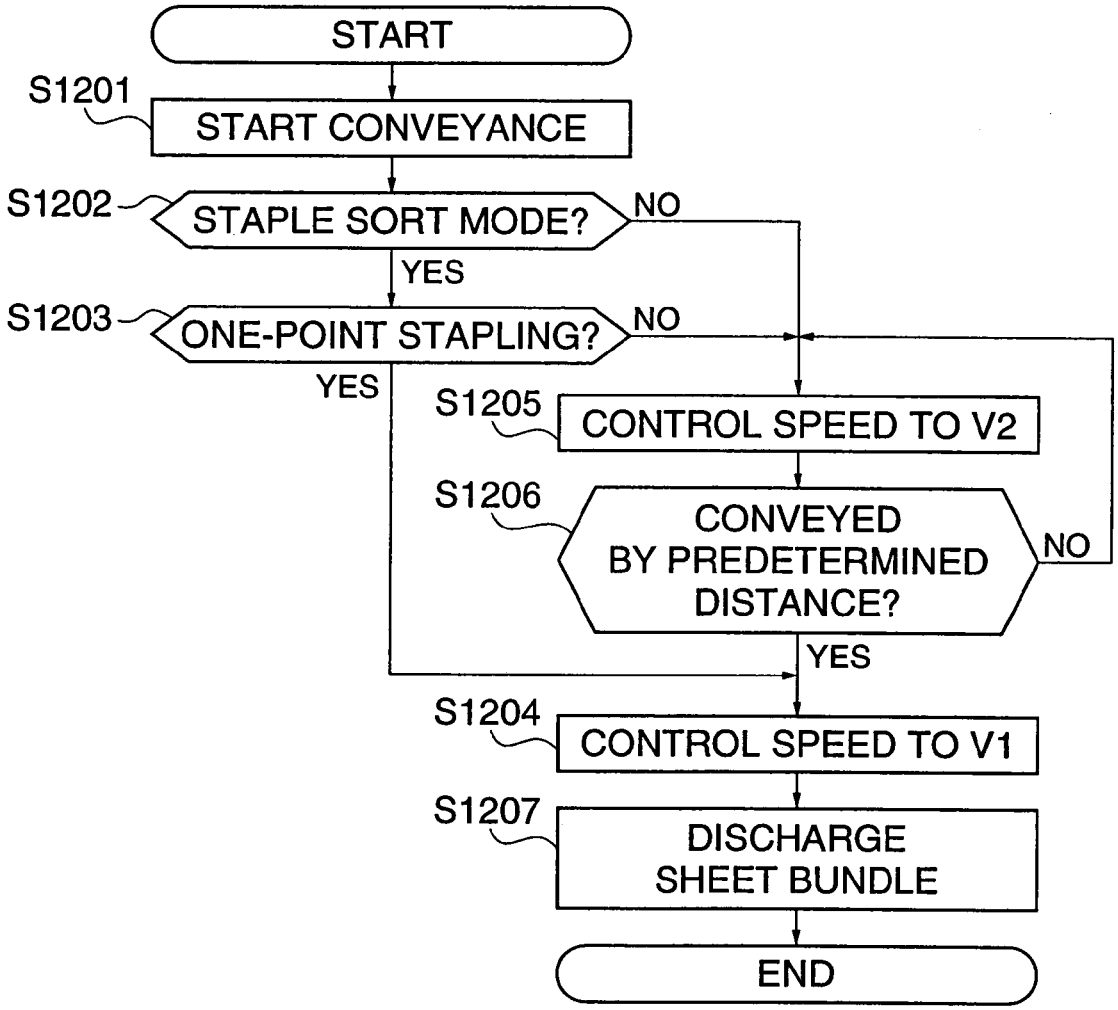
FIG. 11 is a flow chart showing a sheet bundle discharge control process that is carried out by the sheet processing apparatus according to a third embodiment of the present invention.

FIG. 11 is a flow chart showing a sheet bundle discharge control process that is carried out by a sheet processing apparatus according to a third embodiment of the present invention.

The present embodiment differs from the first embodiment described above in that the sheet bundle conveyance speed is controlled to different values between the case where "one-point stapling" is carried and the case where "one-point stapling" is not carried out.

The sheet processing apparatus according to the present embodiment and an image forming apparatus to which the sheet processing apparatus is attached are identical in construction with those of the first embodiment, and hence description of the constructions thereof is omitted.

First, the conveyance of a sheet bundle from the staple tray 12 is started (step S1201). Next, it is determined whether the operation mode is the staple sort mode or not (step S1202), and if it is determined that the operation mode is the staple sort mode, it is then determined whether "one-point stapling" is to be carried out or not (step S1203). If it is determined that "one-point stapling" is to be carried out, the speed of the sheet bundle being conveyed is controlled to be maintained at the predetermined speed V1 (step S1104), and the sheet bundle is discharged onto the stack tray 18 with the conveying speed being maintained at the predetermined speed V1 (step S1207), followed by termination of the present process.

If it is determined in the step S1202 that the operation mode is not the staple sort mode, or if it is determined in the step S1202 that the operation mode is the staple sort mode but it is determined in the step S1203 that "one-point stapling" is not to be carried out (for example, in the case of "two-point stapling"), the speed of the sheet bundle being conveyed is controlled to be maintained at a predetermined speed V2 (step S1205). It is then determined whether the sheet bundle has been conveyed by the predetermined distance or not, and if it is determined that the sheet bundle has been conveyed by the predetermined distance, the speed of the sheet bundle being conveyed is controlled to be maintained at the speed V1 (step S1204), and the sheet bundle is then discharged onto the stack tray 18 with the conveying speed being maintained at the speed V1 (step S1207), followed by termination of the present process. If it is determined in the step S1206 that the sheet bundle has not been conveyed by the predetermined distance, the speed of the sheet bundle being conveyed is controlled to be maintained at the predetermined speed V2 (step S1205).

Figure 12A:
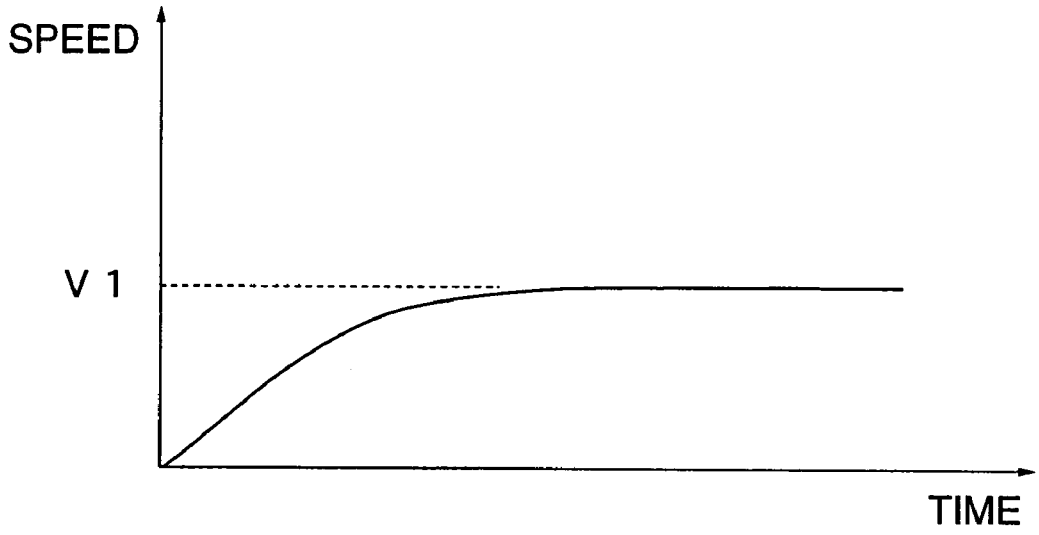
Figure 12B:
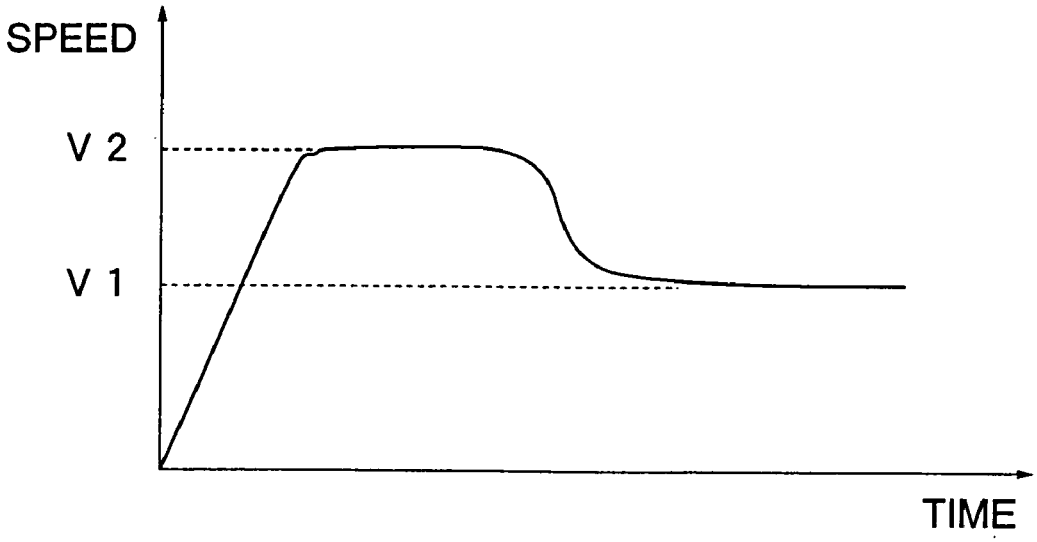

FIGS. 12A and 12B are graphs showing the relationship between the speed and the time when a sheet bundle is discharged, according to the third embodiment, in which FIG. 12A shows a case where "one-point stapling" is not carried out, and FIG. 12B shows a case where "one-point stapling" is carried out.

As shown in FIG. 12B, the speed of the sheet bundle being conveyed is controlled to be maintained at the predetermined speed V2 higher than the predetermined speed V1 until the sheet bundle has been conveyed by the predetermined distance after the start of sheet bundle conveyance, and after the sheet bundle has been conveyed by the predetermined distance, the speed of the sheet bundle being conveyed is controlled to be maintained at the predetermined speed V1. Therefore, in the case shown in FIG. 12B, the sheet bundle is conveyed at a higher speed, and hence the productivity can be improved. Further, since the sheet bundle is slowly conveyed in the case shown in FIG. 12A, it is possible to prevent the sheet bundle from being misaligned at a side edge thereof which has not been subjected to stapling, or becoming torn or wrinkled in the vicinity of the stapling point.

According to the first through third embodiments described above, when a bundle of sheets having been subjected to "one-point stapling" is discharged, the sheet bundle can be prevented from being misaligned at a side edge which has not been subjected to stapling, or becoming torn or wrinkled in the vicinity of the stapling point, whereby the stackability on the stack tray 18 can be improved. Furthermore, in the case where "one-point stapling" is not carried out, the period of time required for the sheet bundle discharge control process can be reduced to improve the productivity.

A description will now be given of a fourth embodiment of the present invention. In the sheet processing apparatus according to the first embodiment described above, the sheet processing apparatus controls the speed of a sheet bundle at the start of the motor in different ways between the case where "one-point stapling" is carried out and the case where "one-point stapling" is not carried out, but in the present embodiment, the speed of a sheet bundle being conveyed is controlled in different ways between the case where the operation mode is the staple sort mode and the case where the operation mode is not the staple sort mode. In the present embodiment, as is the case with the above described embodiments, it is possible to prevent a sheet bundle from being misaligned at a side edge thereof which has not been subjected to stapling, or becoming torn or wrinkled in the vicinity of the stapling point when the bundle of sheets is discharged.

Figure 13:
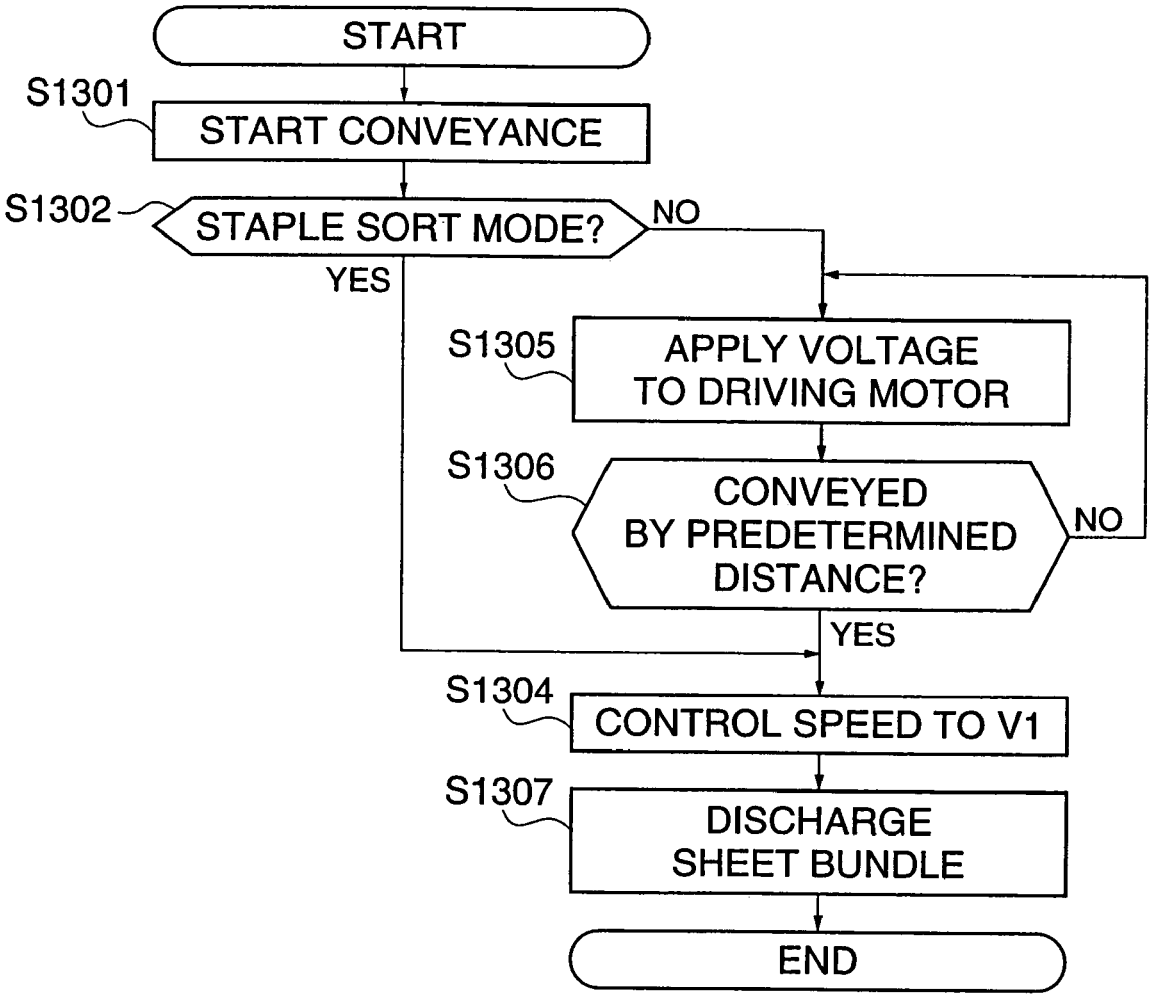
FIG. 13 is a flow chart showing a sheet bundle discharge control process that is carried out by the sheet processing apparatus according to a fourth embodiment of the present invention.

FIG. 13 is a flow chart showing a sheet bundle discharge control process that is carried out by the sheet processing apparatus according to the present embodiment.

The sheet processing apparatus according to the present embodiment and an image forming apparatus to which the sheet processing apparatus is attached are identical in construction with those of the first embodiment, and hence description of the constructions thereof is omitted.

The present embodiment differs from the first embodiment in that the process step of determining whether "one-point stapling" is to be carried out or not is omitted from the sheet bundle discharge control process.

First, the conveyance of a sheet bundle from the staple tray 12 is started (step S1301). Next, it is determined whether the operation mode is the staple sort mode or not (step S1302), and if it is determined that the operation mode is the staple sort mode, the speed of the sheet bundle being conveyed is controlled to be maintained at the predetermined speed V1 (step S1304), and the sheet bundle is then discharged onto the stack tray 18 with the conveying speed being maintained at the predetermined speed V1 (step S1307), followed by termination of the present process.

If it is determined in the step S1302 that the operation mode is not the staple sort mode, voltage is continuously applied to the driving motor 40 until after the sheet bundle has been conveyed by the predetermined distance (step S1305). It is determined whether the sheet bundle has been conveyed by the predetermined distance or not (step S1306). If it is determined that the sheet bundle has been conveyed by the predetermined distance, the speed of the sheet bundle being conveyed is controlled to be maintained at the predetermined speed V1 (step S1304), and the sheet bundle is discharged onto the stack tray 18 with the conveying speed being maintained at the predetermined speed V1 (step S1307).

A description will now be given of a fifth embodiment of the present invention.

In the second embodiment described above, the speed of a sheet bundle being conveyed is controlled in different ways between the case where "one-point stapling" is carried out and the case where "one-point stapling" is not carried out, but in the present embodiment, the speed of a sheet bundle being conveyed is controlled in different ways between the case where the operation mode is the staple sort mode and the case where the operation mode is not the staple sort mode. Also in the present embodiment, the acceleration during sheet bundle conveyance is controlled using a stepping motor in place of the DC motor as the driving motor 40.

Except for the above, the sheet processing apparatus according to the present embodiment and an image forming apparatus to which the sheet processing apparatus is attached are identical in construction with those of the above described first embodiment, and description of the constructions thereof is omitted.

A description will now be given of a sheet bundle discharge process that is carried out by the sheet processing apparatus according to the present embodiment with reference to the flow chart of FIG. 9 showing the sheet bundle discharge control process that is carried out by the sheet processing apparatus according to the second embodiment.

The sheet bundle discharge control according to the present embodiment differs from the one according to the second embodiment in that the process step of determining whether "one-point stapling" is to be carried out or not is omitted from the sheet bundle discharge control.

In the flow chart of FIG. 9, it is determined in the step S1102 whether the operation mode is the staple sort mode or not. If it is determined that the operation mode is the staple sort mode, the process proceeds to the step S1104 without determining in the step S1103 whether "one-point stapling" is to be carried out or not, and in the step S1104, a sheet bundle is accelerated at the acceleration $\alpha$2. If it is determined in the step S1102 that the operation mode is not the staple sort mode, the process proceeds to the step S1107 wherein the sheet bundle is accelerated at the acceleration $\alpha$1.

A description will now be given of a sixth embodiment of the present invention.

In the above described third embodiment, the speed of a sheet bundle being conveyed is controlled in different ways between the case where "one-point stapling" is carried out and the case where "one-point stapling" is not carried out, but in the present embodiment, the speed of a sheet bundle being conveyed is controlled in different ways between the case where the operation mode is the staple sort mode and the case where the operation mode is not the staple sort mode.

A description will now be given of a sheet bundle discharge process that is carried out by the sheet processing apparatus according to the present embodiment with reference to the flow chart of FIG. 11 showing the sheet bundle discharge control process that is carried out by the sheet processing apparatus according to the third embodiment. The sheet bundle discharge control according to the present embodiment differs from that according to the third embodiment in that the process step of determining whether "one-point stapling" is to be carried out or not is omitted from the sheet bundle discharge control process.

In the flow chart of FIG. 11, it is determined in the step S1202 whether the operation mode is the staple sort mode or not. If it is determined that the operation mode is the staple sort mode, the process proceeds to the step S1204 without determining in the step S1203 whether "one-point stapling" is to be carried out or not, and in the step S1204, the sheet bundle conveying speed is controlled to be mainlined at the predetermined speed V1. If it is determined in the step S1202 that the operation mode is not the staple sort mode, the process proceeds to the step S1205 wherein the sheet bundle conveying speed is controlled to be maintained at the predetermined speed V2.

According to the above described fourth through sixth embodiments, when a sheet bundle having been subjected to "one-point stapling" is discharged, the sheet bundle can be prevented from being misaligned at a side edge thereof which has not been subjected to stapling, or becoming torn or wrinkled in the vicinity of the stapling point, whereby the productivity can be improved. Further, in the case where "one-point stapling" is not carried out, the period of time required for the sheet bundle discharge control can be reduced to improve the productivity. Further, in the case of "two-point stapling" as well as "one-point stapling", when a sheet bundle is discharged, it is possible to prevent the sheet bundle from being misaligned at a side edge thereof which has not been subjected to stapling, or becoming torn or wrinkled in the vicinity of the stapling point.

It should be noted that in the sheet processing apparatus according to any of the above described embodiments, when a sheet bundle is discharged from the staple tray 12 onto the stack tray 18, whether the sheet bundle has been conveyed by a predetermined distance or not can be determined according to the result of detection using a sheet bundle sensor which is additionally provided.

It should be understood that the present invention is not limited to the embodiments described above, but various variations of the above described embodiments may be possible without departing from the spirits of the present invention.

What claimed is:

1. A sheet processing apparatus comprising:

a stapling device that staples a sheet bundle comprising a plurality of sheets;

a discharge device that discharges the sheet bundle;

a driving device that drives said discharge device; and a controller that controls said driving device; and wherein said controller controls a discharge speed of the sheet bundle in different ways after the controller initiates the driving device to move the sheet bundle between a case where said stapling device staples the sheet bundle at one point thereof and a case where said stapling device staples the sheet bundle at two points thereof.

2. A sheet processing apparatus according to claim 1, wherein:

the sheet bundle stapled at one point thereof is a sheet bundle stapled at one of corners thereof by said stapling device; and the sheet bundle stapled at two points thereof is a sheet bundle stapled by said stapling device at symmetrical points thereof with reaped to a middle part thereof in a direction of sheet width perpendicular to a sheet bundle conveying direction.

3. A sheet processing apparatus according to claim 1, wherein:

said controller is operable when the sheet bundle stapled at one point thereof is to be discharged, for causing said discharge device to discharge the sheet bundle at a first predetermined speed; and said controller is operable when discharging the sheet bundle stapled at two points thereof, for continuously applying a predetermined voltage to said driving device to cause said discharge device to convey the sheet bundle until after the sheet bundle has been conveyed by a predetermined distance, and is operable after the sheet bundle has been conveyed by the predetermined distance, for causing said discharge device to discharge the sheet bundle at the first predetermined speed.

4. A sheet processing apparatus comprising:

a stapling device that staples a sheet bundle comprising a plurality of sheets;

a discharge device that discharges the sheet bundle;

a driving device that drives said discharge device; and a controller that controls said driving device; and wherein said controller controls a discharge speed of the sheet bundle in different ways after the controller initiates the driving device to move the sheet bundle between a case where said stapling device staples the sheet bundle and a case where said stapling device does not staple the sheet bundle.

5. A sheet processing apparatus according to claim 4, wherein:

said controller is operable when a stapled sheet bundle is to be discharged, for causing said discharge device to discharge the sheet bundle at a first predetermined speed; and said controller is operable when an unstapled sheet bundle is to be discharged, for continuously applying a predetermined voltage to said driving device to cause said discharge device to convey the sheet bundle until after the sheet bundle has bean conveyed by a predetermined distance, end is operable after the sheet bundle has been conveyed by the predetermined distance, for causing said discharge device to discharge the sheet bundle at the first predetermined speed.

* * * * *